US010388125B2

(12) United States Patent
Robinson

(10) Patent No.: US 10,388,125 B2
(45) Date of Patent: Aug. 20, 2019

(54) COMMUNICATING A LOCALIZED BUILDING ALERT

(71) Applicant: LENOVO (Singapore) PTE. LTD., New Tech Park (SG)

(72) Inventor: Douglas Warren Robinson, Raleigh, NC (US)

(73) Assignee: LENOVO (SINGAPORE) PTE. LTD, New Tech Park (CH)

( * ) Notice: Subject to any disclaimer, the term of this patent is extended or adjusted under 35 U.S.C. 154(b) by 131 days.

(21) Appl. No.: 15/182,139

(22) Filed: Jun. 14, 2016

(65) Prior Publication Data

US 2017/0358184 A1 Dec. 14, 2017

(51) Int. Cl.

| | |
|---|---|
| ***A62B 3/00*** | (2006.01) |
| ***G08B 7/06*** | (2006.01) |
| ***F21S 9/02*** | (2006.01) |

(52) U.S. Cl.

CPC ..... *G08B 7/066* (2013.01); *F21S 9/022* (2013.01); *F21S 9/024* (2013.01); *G08B 7/064* (2013.01)

(58) Field of Classification Search

CPC ..... G08B 7/066; G08B 7/064; G08B 25/006; F21S 9/022; F21S 9/024; B66B 5/024

USPC ..... 340/691.5, 573.4

See application file for complete search history.

(56) References Cited

U.S. PATENT DOCUMENTS

| | | | | |
|---|---|---|---|---|
| 4,709,330 | A * | 11/1987 | Yokoi | A62B 3/00 340/573.4 |
| 2015/0170503 | A1* | 6/2015 | Wedig | G08B 7/066 340/691.5 |
| 2016/0123741 | A1* | 5/2016 | Mountain | G01C 21/206 701/533 |
| 2016/0134932 | A1* | 5/2016 | Karp | H04W 4/80 348/155 |

* cited by examiner

*Primary Examiner* — Munear T Akki
(74) *Attorney, Agent, or Firm* — Kunzler Bean & Adamson

(57) ABSTRACT

For communicating a localized building alert, a processor detects an emergency event. In response to detecting the emergency event, the processor communicates a localized building alert through a lighting system. The localized building alert is restricted to a location of one of an aid recipient and an aid giver.

13 Claims, 12 Drawing Sheets

215

| | | | |
|---|---|---|---|
| 261a | Sensor Data 260 | Emergency Event Type 265 | Building Alert Data 270 |
| 261b | Sensor Data 260 | Emergency Event Type 265 | Building Alert Data 270 |
| 261c | Sensor Data 260 | Emergency Event Type 265 | Building Alert Data 270 |
| 261d | Sensor Data 260 | Emergency Event Type 265 | Building Alert Data 270 |

FIG. 2C

270

| |
|---|
| Default Alert Pattern 275 |
| Aid Recipient Alert Pattern 280 |
| Route Alert Pattern 285 |
| Aid Giver Alert Pattern 290 |

FIG. 2D

COMMUNICATING A LOCALIZED BUILDING ALERT

BACKGROUND

Field

The subject matter disclosed herein relates to building alerts and more particularly relates to communicating localized building alerts.

Description of the Related Art

A building sensors and/or biosensors may detect an emergency event for an aid recipient.

BRIEF SUMMARY

An apparatus for communicating a localized building alert is disclosed. The apparatus includes a building controller that controls a building system, a processor, and a memory that stores code executable by the processor. The building system includes a lighting system. The processor detects an emergency event. In response to detecting the emergency event, the processor communicates a localized building alert through the lighting system. The localized building alert is restricted to a location of one of an aid recipient and an aid giver. A method and program product also perform the functions of the apparatus.

BRIEF DESCRIPTION OF THE DRAWINGS

A more particular description of the embodiments briefly described above will be rendered by reference to specific embodiments that are illustrated in the appended drawings. Understanding that these drawings depict only some embodiments and are not therefore to be considered to be limiting of scope, the embodiments will be described and explained with additional specificity and detail through the use of the accompanying drawings, in which:

FIG. 2C is a schematic block diagram illustrating one embodiment of emergency event protocols;

FIG. 2D is a schematic block diagram illustrating one embodiment of building alert data;

DETAILED DESCRIPTION

Figure 1A:
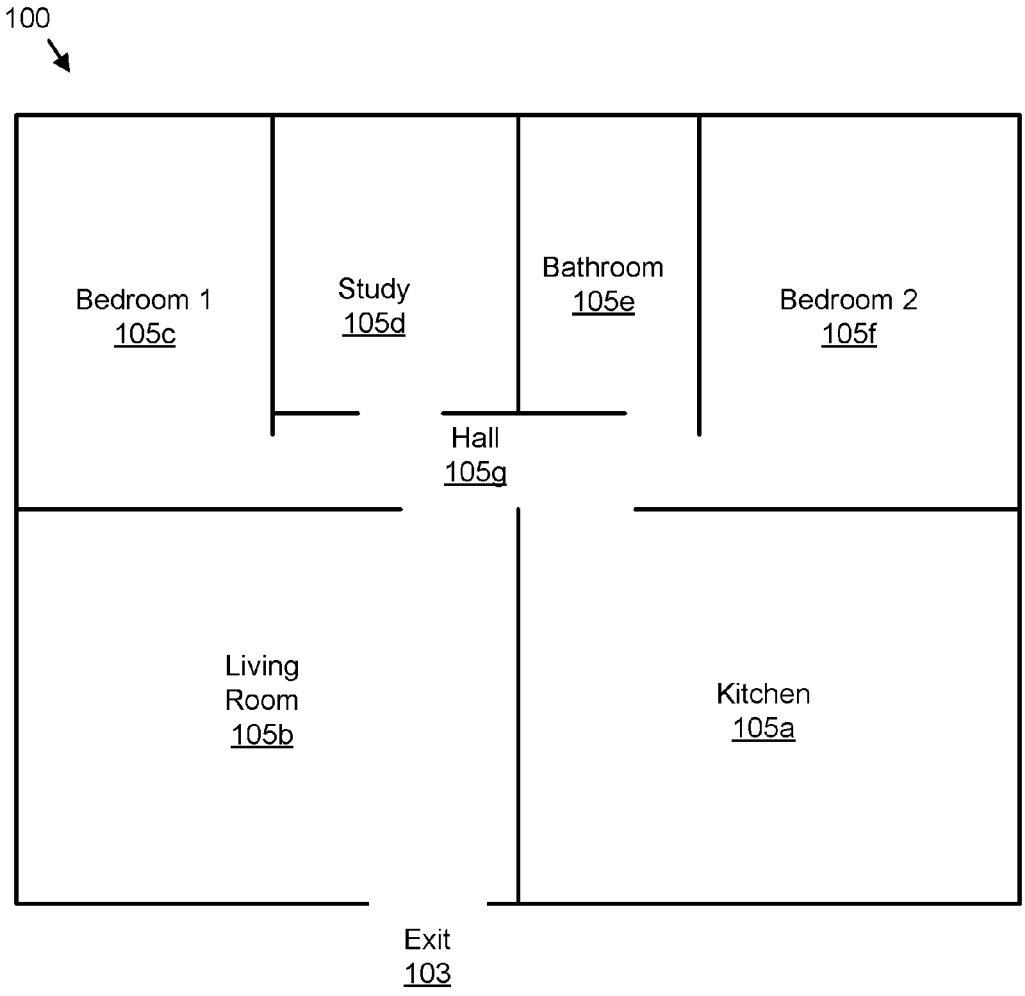
FIG. 1A is a floor plan illustrating one embodiment of a building.

As will be appreciated by one skilled in the art, aspects of the embodiments may be embodied as a system, method or program product. Accordingly, embodiments may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, embodiments may take the form of a program product embodied in one or more computer readable storage devices storing machine readable code, computer readable code, and/or program code, referred hereafter as code. The storage devices may be tangible, non-transitory, and/or non-transmission. The storage devices may not embody signals. In a certain embodiment, the storage devices only employ signals for accessing code.

Many of the functional units described in this specification have been labeled as modules, in order to more particularly emphasize their implementation independence. For example, a module may be implemented as a hardware circuit comprising custom VLSI circuits or gate arrays, off-the-shelf semiconductors such as logic chips, transistors, or other discrete components. A module may also be implemented in programmable hardware devices such as field programmable gate arrays, programmable array logic, programmable logic devices or the like.

Modules may also be implemented in code and/or software for execution by various types of processors. An identified module of code may, for instance, comprise one or more physical or logical blocks of executable code which may, for instance, be organized as an object, procedure, or function. Nevertheless, the executables of an identified module need not be physically located together, but may comprise disparate instructions stored in different locations which, when joined logically together, comprise the module and achieve the stated purpose for the module.

Indeed, a module of code may be a single instruction, or many instructions, and may even be distributed over several different code segments, among different programs, and across several memory devices. Similarly, operational data may be identified and illustrated herein within modules, and may be embodied in any suitable form and organized within any suitable type of data structure. The operational data may be collected as a single data set, or may be distributed over different locations including over different computer readable storage devices. Where a module or portions of a module are implemented in software, the software portions are stored on one or more computer readable storage devices.

Any combination of one or more computer readable medium may be utilized. The computer readable medium may be a computer readable storage medium. The computer readable storage medium may be a storage device storing the code. The storage device may be, for example, but not limited to, an electronic, magnetic, optical, electromagnetic, infrared, holographic, micromechanical, or semiconductor system, apparatus, or device, or any suitable combination of the foregoing.

More specific examples (a non-exhaustive list) of the storage device would include the following: an electrical connection having one or more wires, a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

Code for carrying out operations for embodiments may be written in any combination of one or more programming languages including an object oriented programming language such as Python, Ruby, Java, Smalltalk, C++, or the like, and conventional procedural programming languages, such as the "C" programming language, or the like, and/or machine languages such as assembly languages. The code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to," unless expressly specified otherwise. An enumerated listing of items does not imply that any or all of the items are mutually exclusive, unless expressly specified otherwise. The terms "a," "an," and "the" also refer to "one or more" unless expressly specified otherwise.

Furthermore, the described features, structures, or characteristics of the embodiments may be combined in any suitable manner. In the following description, numerous specific details are provided, such as examples of programming, software modules, user selections, network transactions, database queries, database structures, hardware modules, hardware circuits, hardware chips, etc., to provide a thorough understanding of embodiments. One skilled in the relevant art will recognize, however, that embodiments may be practiced without one or more of the specific details, or with other methods, components, materials, and so forth. In other instances, well-known structures, materials, or operations are not shown or described in detail to avoid obscuring aspects of an embodiment.

Aspects of the embodiments are described below with reference to schematic flowchart diagrams and/or schematic block diagrams of methods, apparatuses, systems, and program products according to embodiments. It will be understood that each block of the schematic flowchart diagrams and/or schematic block diagrams, and combinations of blocks in the schematic flowchart diagrams and/or schematic block diagrams, can be implemented by code. These code may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the schematic flowchart diagrams and/or schematic block diagrams block or blocks.

The code may also be stored in a storage device that can direct a computer, other programmable data processing apparatus, or other devices to function in a particular manner, such that the instructions stored in the storage device produce an article of manufacture including instructions which implement the function/act specified in the schematic flowchart diagrams and/or schematic block diagrams block or blocks.

The code may also be loaded onto a computer, other programmable data processing apparatus, or other devices to cause a series of operational steps to be performed on the computer, other programmable apparatus or other devices to produce a computer implemented process such that the code which execute on the computer or other programmable apparatus provide processes for implementing the functions/acts specified in the flowchart and/or block diagram block or blocks.

The schematic flowchart diagrams and/or schematic block diagrams in the Figures illustrate the architecture, functionality, and operation of possible implementations of apparatuses, systems, methods and program products according to various embodiments. In this regard, each block in the schematic flowchart diagrams and/or schematic block diagrams may represent a module, segment, or portion of code, which comprises one or more executable instructions of the code for implementing the specified logical function(s).

It should also be noted that, in some alternative implementations, the functions noted in the block may occur out of the order noted in the Figures. For example, two blocks shown in succession may, in fact, be executed substantially concurrently, or the blocks may sometimes be executed in the reverse order, depending upon the functionality involved. Other steps and methods may be conceived that are equivalent in function, logic, or effect to one or more blocks, or portions thereof, of the illustrated Figures.

Although various arrow types and line types may be employed in the flowchart and/or block diagrams, they are understood not to limit the scope of the corresponding embodiments. Indeed, some arrows or other connectors may be used to indicate only the logical flow of the depicted embodiment. For instance, an arrow may indicate a waiting or monitoring period of unspecified duration between enumerated steps of the depicted embodiment. It will also be noted that each block of the block diagrams and/or flowchart diagrams, and combinations of blocks in the block diagrams and/or flowchart diagrams, can be implemented by special purpose hardware-based systems that perform the specified functions or acts, or combinations of special purpose hardware and code.

The description of elements in each figure may refer to elements of proceeding figures. Like numbers refer to like elements in all figures, including alternate embodiments of like elements.

FIG. 1A is a floor plan illustrating one embodiment of a building 100. In the depicted embodiment, the building 100 is a residence. Any building and/or building floor plan may be employed without limitation. The building 100 includes a plurality of rooms 105. The building 100 further includes an exit 103.

During an emergency event, it may be critical to move an aid recipient from the building 100 through the exit 103. Alternatively, the emergency event necessitate moving an aid giver through the exit 103 and the building 100 to the aid recipient. The emergency event may be a physical emergency event detected by a building sensor. The physical emergency event may be selected from the group consisting of a fire, a flood, extreme weather, and a home invasion. Alternatively, the emergency event may be a medical emergency event detected by a biosensor and/or the building sensor.

Extenuating circumstances such as smoke, structural damage, and the like may make it difficult to locate an aid recipient within the building 100. In addition, the extenuating circumstances may make it difficult for the aid recipient to find an egress route and/or the aid giver to find a rescue route through the building 100. An aid giver may also be uncertain as to the type of aid required by the aid recipient.

The embodiments described herein detect an emergency event and in response to detecting emergency event, communicate a localized building alert through a building system for the building. The localized building alert may be restricted to a location of an aid recipient and/or an aid giver. The localized building alert may encode information that identifies the aid recipient, identifies an egress route, and/or identifies a rescue route as will be described hereafter.

Figure 1B:
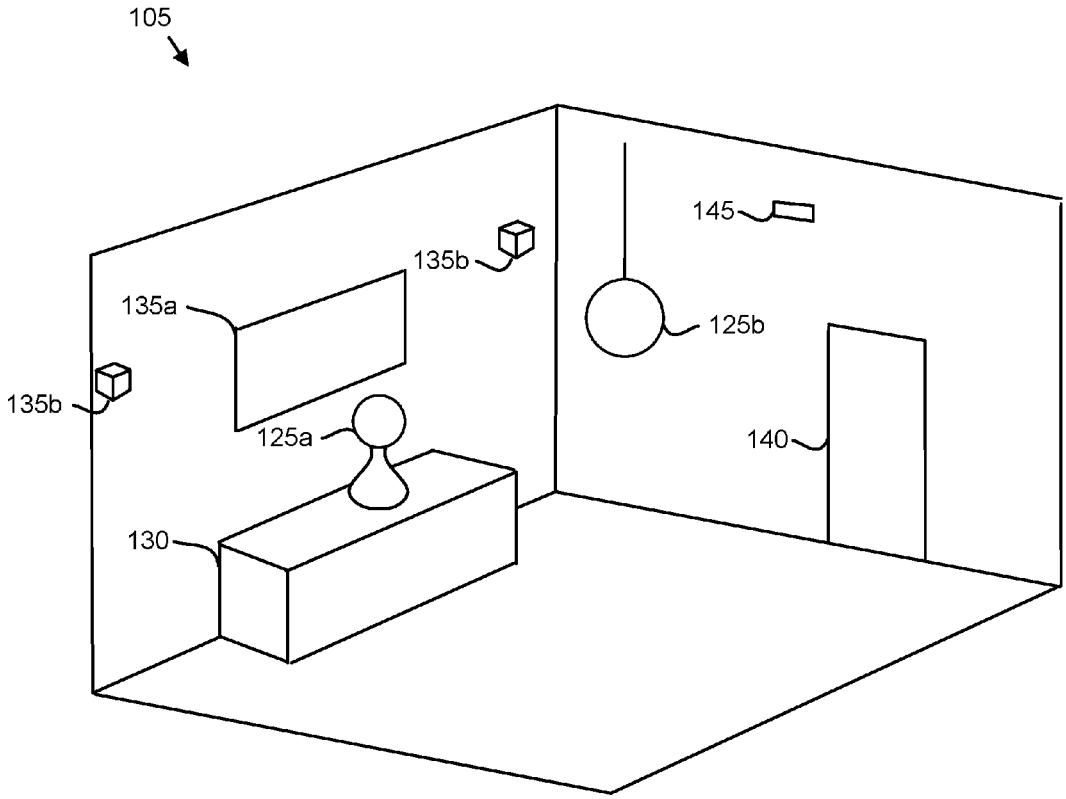
FIG. 1B is a perspective drawing illustrating one embodiment of a room.

FIG. 1B is a perspective drawing illustrating one embodiment of a room 105. The depicted room 105 is exemplary of a room and is not limiting. The room 105 includes one or more lights of a lighting system 125, furniture 130, one or more entertainment systems 135, a door 140, and a building sensor 145. The entertainment systems 135 may include a video display 135*a* and/or speakers 135*b*. The building sensor 145 may be selected from the group consisting of a smoke detector, an infrared detector, a water sensor, an accelerometer, a motion detector, an optical camera, and a microphone. The door 140 may include a lock.

In one embodiment, the lighting system 125, entertainment systems 135, door 140, and/or building sensor 145 may be incorporated in a building system. The building system is described in more detail in FIG. 1D. The building system may turn the lights of the light system 125 on and/or off. In addition, the building system may activate the entertainment systems 135 and communicate a localized building alert through the entertainment systems 135.

In one embodiment, the building system may receive data from the building sensor 145. In addition, the building system may lock and unlock the door 140.

Figure 1C:
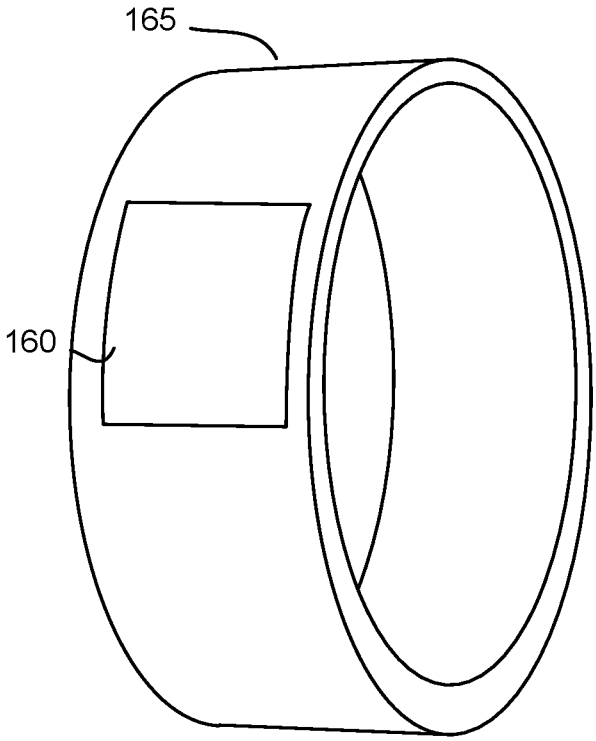
FIG. 1C is a perspective drawing illustrating one embodiment of a biosensor.

FIG. 1C is a perspective drawing illustrating one embodiment of a biosensor 160. The biosensor 160 may be embodied in a wearable device 165. The biosensor 160 may communicate with a building alert system and/or the building system. In addition, the biosensor 160 may determine a location of an aid recipient within the building 100. In one embodiment, the electronic device 165 determines the health of the aid recipient. The biosensor 160 may be selected from the group consisting of a heart rate monitor, a pulse monitor, and infrared camera, an optical camera, and a microphone.

Figure 1D:
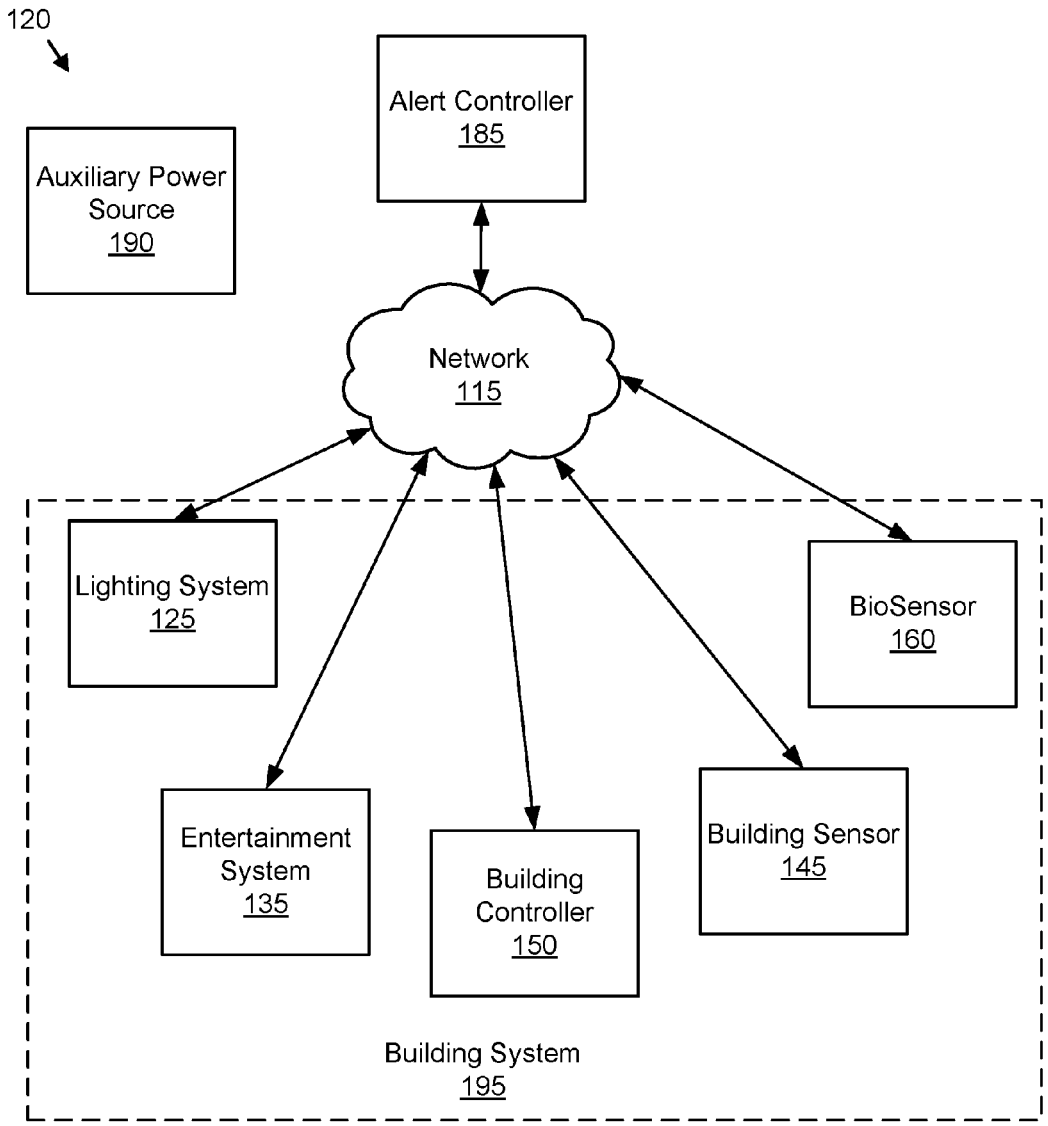
FIG. 1D is a schematic block diagram illustrating one embodiment of a building alert system.

FIG. 1D is a schematic block diagram illustrating one embodiment of the building alert system 120. In the depicted embodiment, the building alert system 120 includes the building system 195, a network 115, an auxiliary power source 190, and an alert controller 185. The building system 195 may include the lighting system 125, the entertainment system 135, a building controller 150, the building sensor 145, and the biosensor 160.

The auxiliary power source 190 may supply power to the alert controller 185 and/or elements of the building system 195 during a power failure. As a result, the building alert system 120 may operate during an emergency event. The network 115 may be a local area network, a Wi-Fi network, a data bus, a mobile telephone network, or combinations thereof. The alert controller 185 may communicate with the building system 195 through the network 115. In one embodiment, the alert controller 185 communicates only with the building controller 150. Alternatively, the alert controller 185 may communicate directly with one or more of the lighting system 125, the entertainment system 135, the building controller 150, the building sensor 145, and the biosensor 160.

Figure 2A:
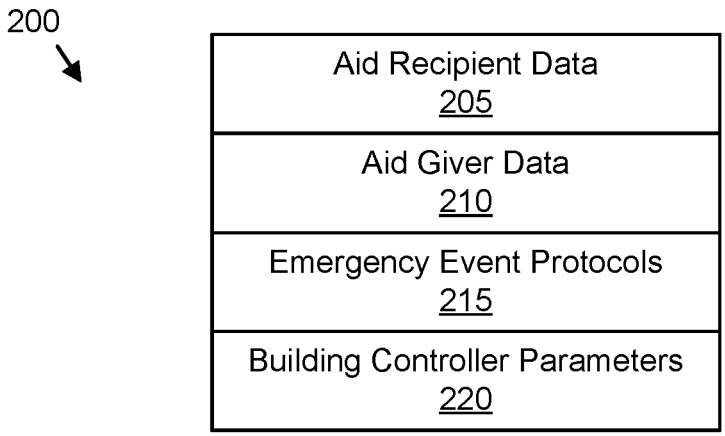
FIG. 2A is a schematic block diagram illustrating one embodiment of building alert data.

FIG. 2A is a schematic block diagram illustrating one embodiment of building alert data 200. The building alert data 200 may be organized as a data structure in a memory. In the depicted embodiment, the building alert data 200 includes aid recipient data 205, aid giver data 210, emergency event protocols 215, and building controller parameters 220.

The aid recipient data 205 may describe one or more aid recipients. The aid giver data 210 may describe one or more aid givers. The aid recipient data 205 and aid giver data 210 are described in more detail in FIG. 2B.

The emergency event protocols 215 may be used to determine an emergency event from sensor data. The emergency event protocols 215 may further be used to determine a building alert. The emergency event protocols 215 are described in more detail in FIG. 2C.

The building controller parameters 220 may include parameters and routines for interfacing with the building controller 150 and/or the building system 195. In one embodiment, the building controller parameters 220 includes a conversion table that converts commands from the alert controller 185 to commands for the building controller 150 and/or the building system 195. Alternatively, the building controller parameters 220 may include parameters and routines for performing functions of the embodiments on the building controller 150.

Figure 2B:
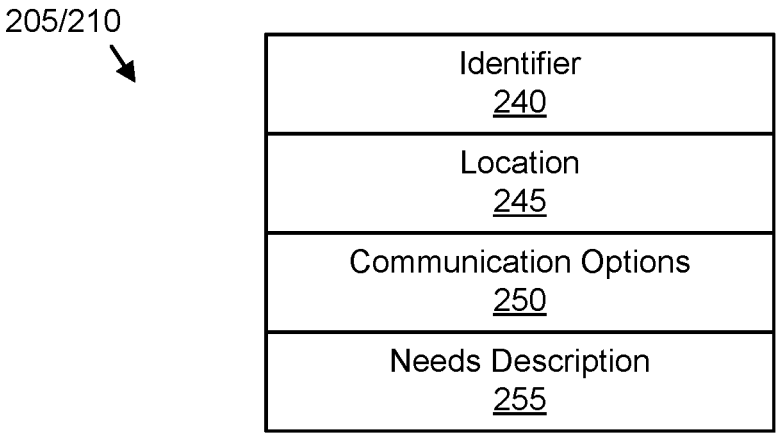
FIG. 2B is a schematic block diagram illustrating one embodiment of aid recipient data and aid giver data.

FIG. 2B is a schematic block diagram illustrating one embodiment of aid recipient data 205/aid giver data 210. The aid recipient data 205 and aid giver data 210 may share a common format. The aid recipient data 205 and the aid giver data 210 may be organized as a data structure in a memory. In the depicted embodiment, the aid recipient data 205 and the aid giver data 210 includes an identifier 240, a location 245, communication options 250, and a needs description 255.

The identifier 240 may uniquely identify an individual that is an aid recipient and/or aid giver. The identifier 240 may include a name, an image, and/or an identification code for the individual. The identification code may be incorporated in a localized building alert as will be described hereafter.

The location 245 may specify where the individual is located in the building 100. The location 245 may be determined from one or more building sensors 145 and/or the biosensor 160. The location 245 may specify a room. Alternatively, the location 245 may specify coordinates within a building 100.

The communication options 250 may specify one or more ways for communicating with the individual. The communication options 250 may indicate that the individual can receive visual communication. In addition, the communication options 250 may indicate that the individual can receive audio communication. The communication options 250 may include a mobile phone number for an aid recipient individual. Alternatively, the communication options 250 may include a radio frequency for an aid giver individual.

In one embodiment, the communication options 250 include a mobile telephone number, email address, messaging address, or the like for the individual. The communication options 250 may specify a preferred means of communicating with the individual. For example, the individual may specify one or more communication options 250.

The needs description 255 may specify need specific to the individual in an emergency event. For example, the needs description 255 may specify aid that the individual requires when moving, environmental sensitivities, medical conditions, and the like.

FIG. 2C is a schematic block diagram illustrating one embodiment of emergency event protocols 215. The emergency event protocols 215 may be organized as a data structure in a memory. The emergency event protocols 215 may include one or more emergency event protocol entries 261*a-d*. In the depicted embodiment, each emergency event protocol entry 261 includes sensor data 260, an emergency event type 265, and building alert data 270.

The sensor data 260 may describe one or more combinations of data from building sensors 145 and/or biosensors 160. For example, the sensor data 260 may include data on visibility within a room, room temperatures, infrared heat sources, and the like from a building sensor 145. In addition, the sensor data 260 may include a heart rate, a body temperature, a blood sugar level, a respiration rate, and the like.

The emergency event type 265 may specify an emergency event that corresponds to the sensor data 260. For example, the emergency event type 265 of a fire may correspond to one or more measurements of reduced visibility, high room temperatures, an active infrared heat source, and the like from one or more building sensors 145.

The building alert data 270 may specify a localized building alert that corresponds to the emergency event type 265. The building alert data 270 is described in more detail in FIG. 2D.

FIG. 2D is a schematic block diagram illustrating one embodiment of the building alert data 270. The building alert data 270 may be organized as a data structure in a memory. In the depicted embodiment, the building alert data 270 includes a default alert pattern 275, an aid recipient alert pattern 280, a route alert pattern 285, and an aid giver alert pattern 290.

The default alert pattern 275 may specify a communication pattern for the localized building alert that may be used when there is no aid recipient alert pattern 280 for an identified aid recipient, no route alert pattern 285, and/or no aid giver alert pattern 290 for an identified aid giver. The default alert pattern 275 may correspond to the emergency event type 265.

The aid recipient alert pattern 280 may be customized to an aid recipient. In one embodiment, the aid recipient alert pattern 280 is encoded with the identification code for the aid recipient. In addition, the aid recipient alert pattern 280 may specify preferred communication options 250 for the aid recipient.

The route alert pattern 285 may specify a communication pattern for indicating one or more of an egress route and a rescue route. The communication pattern for the egress route may be specified by an aid recipient. For example, the aid recipient may specify a communication pattern for the egress route as options for the alert controller 185. In one embodiment, the route alert pattern 285 sequentially indicates rooms along a route. In addition, the route alert pattern 285 may be localized to only rooms 105 of the route. In a certain embodiment, the route alert pattern 285 is localized to only the room 105 occupied by an aid recipient or aid giver and a next room along the route. In one embodiment, the route alert pattern 285 is concurrently localized to all rooms 105 along the route.

The aid giver alert pattern 290 may specify a communication pattern that alerts an aid giver that the building alert system 120 is providing information regarding the location of an aid recipient, a rescue route, or combinations thereof. The aid giver alert pattern 290 may be a standardized, predetermined communication pattern. In one embodiment, the aid giver alert pattern 290 may encode an identity, skills, or the like of the aid giver.

Figure 3A:
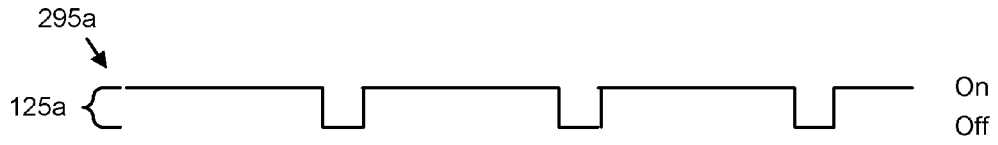
FIG. 3A is a graph illustrating one embodiment of a pulsing building alert.

FIG. 3A is a graph illustrating one embodiment of a pulsing building alert 295*a*. In the depicted embodiment, the pulsing building alert 295*a* comprises a pattern that is predominantly on and that periodically pulses off. For example, the pulsing building alert 295*a* may be communicated through the lighting system 125 with the lights of the lighting system 125 predominantly turned on/illuminated and periodically turned off. Alternatively, the pulsing building alert 295*a* may be communicated by communicating audio signal through the entertainment system 135 and periodically pulsing the audio signal off. In one embodiment, the off period exceeds the on period.

Figure 3B:
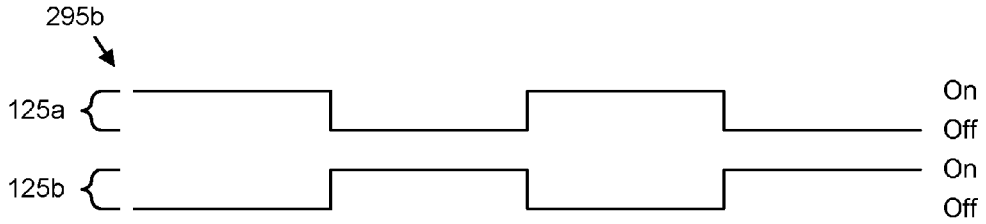
FIG. 3B is a graph illustrating one embodiment of an alternating building alert.

FIG. 3B is a graph illustrating one embodiment of an alternating building alert 295*b*. In the depicted embodiment, the alternating building alert 295*b* comprises a pattern that alternates between on and off. For example, the alternating building alert 295*b* may be communicated to the lighting system 125 with the lights of the lighting system 125 alternating between being turned on/illuminated and being turned off. Alternatively, the alternating building alert 295*b* may be communicated by alternating between communicating an audio signal through the entertainment system 135 and turning off the audio signal.

Figure 3C:
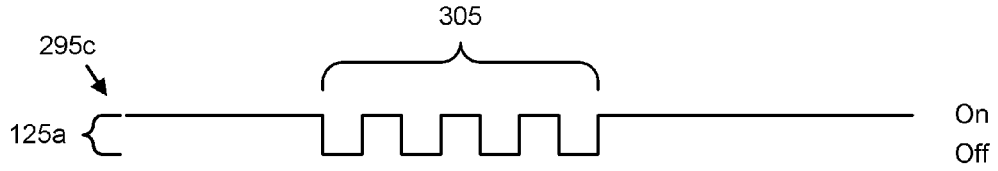
FIG. 3C is a graph illustrating one embodiment of an identification building alert.

FIG. 3C is a graph illustrating one embodiment of an identification building alert 290 5C. In the depicted embodiment, the identification building alert 295*c* comprises a pattern that is predominantly on with a specified number of off pulses that occur periodically. In one embodiment, the specified number of off pulses encode the identification code of the identifier 240. The number of off pulses may indicate the identity of an aid recipient.

In one embodiment, the number of off pulses encodes the needs description 255 of the aid recipient. For example, if the aid recipient is unable to walk, this needs description 255 may be encoded as two pulses.

The number of pulses may encode a number of aid recipients. For example, if three aid recipients are located in the building 100, the identification building alert 295*c* may be encoded with three pulses.

The building alert 295*a-c* may be encoded using pulsing lights of different colors, audible instructions, or combinations thereof. For example, the building alert 295*a-c* may illuminate standard lights of the lighting system 125 while pulsing one or more colored lights and communicating audible instructions through the entertainment system 135.

Figure 3D:
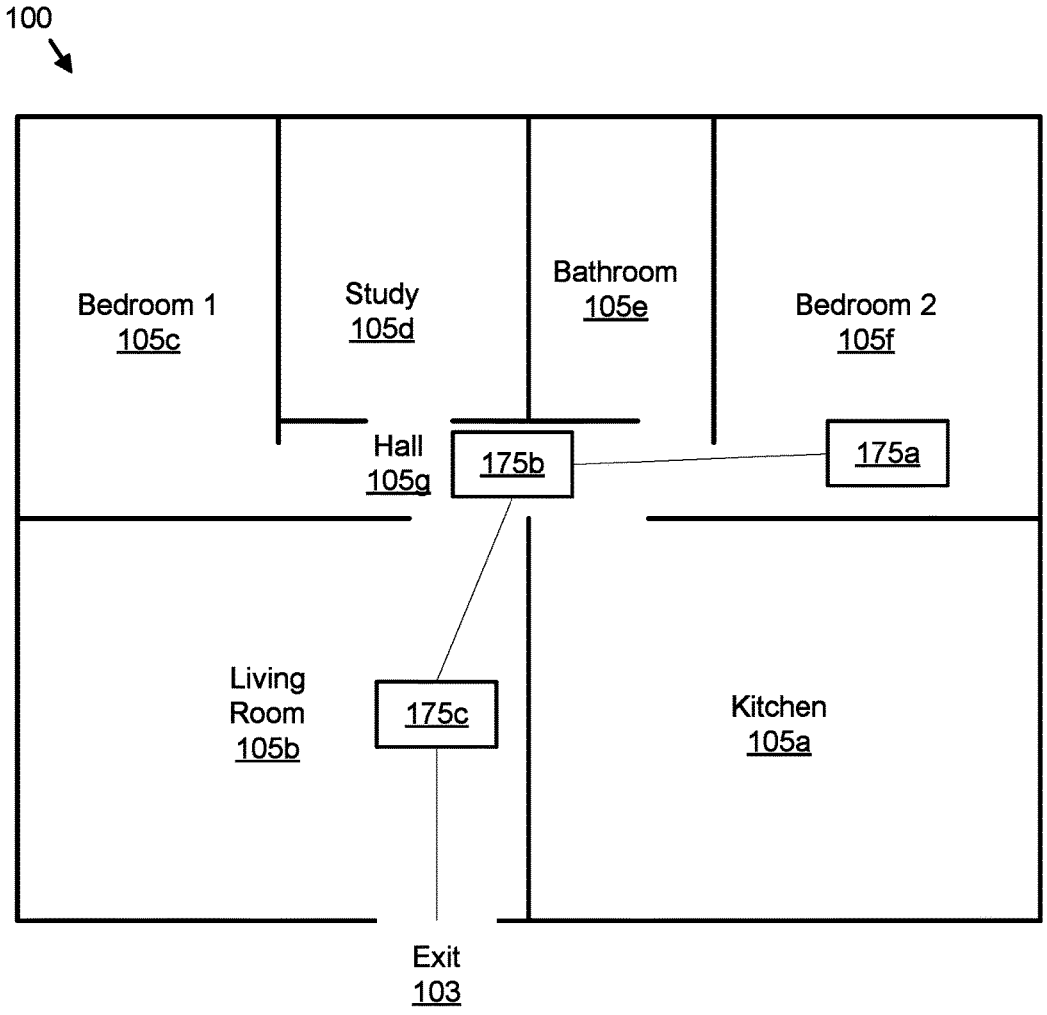
FIG. 3D is a floor plan illustrating one embodiment of an egress route.

FIG. 3D is a floor plan illustrating one embodiment of an egress route 175. A building alert 295 may be encoded with the egress route 175 to guide an aid recipient from the building 100. The floor plan of the building 100 is shown with an egress route 175*a-c* indicated from bedroom 2 105*f* to the exit 103. In one embodiment, a localized building alert 295 is communicated along the egress route 175*a-c*. In a certain embodiment, the localized building alert 295 is initially communicated in the room 105 where the aid recipient is located. The localized building alert 295 may be subsequently communicated in the next room 105 along the egress route 175*a-c*. When the aid recipient arrives in the next room 105 along egress route 175*a-c*, the localized building alert 295 may be subsequently communicated in a second next room 105 along the egress route 175*a-c*. In the depicted embodiment, the localized building alert 295 may be first communicated in bedroom 2 105*f*, then in a hall 105*g*. When the aid recipient reaches the hall 105*g*, the localized building alert 295 may be communicated in the living room 105*b*. When the aid recipient reaches the living room 105*b*, the localized building alert 295 may be communicated outside of the exit 103.

In one embodiment, the localized building alert 295 is no longer communicated in a room 105 after the aid recipient leaves the room 105. In a certain embodiment, the localized building alert 295 is concurrently communicated in each room 105 along the egress route 175.

In addition, the localized building alert 295 may employ the identification building alert 295*c* with the identification building alert 295*c* encoding a number assigned to each room 105 along the egress route 175. For example, the identification building alert 295*c* may comprise one pulse in bedroom 2 105*f*, two pulses in the hall 105*g*, three pulses in the living room 105*b*, and four pulses at the exit 103.

In one embodiment, the localized building alert 295 is not communicated in rooms 105 that are not along the egress route 175 and/or that do not have aid recipients. In a certain embodiment, the lights of the lighting system 125 are dimmed in rooms 105 that are not along the egress route 175 and/or that do not have aid recipients.

Figure 3E:
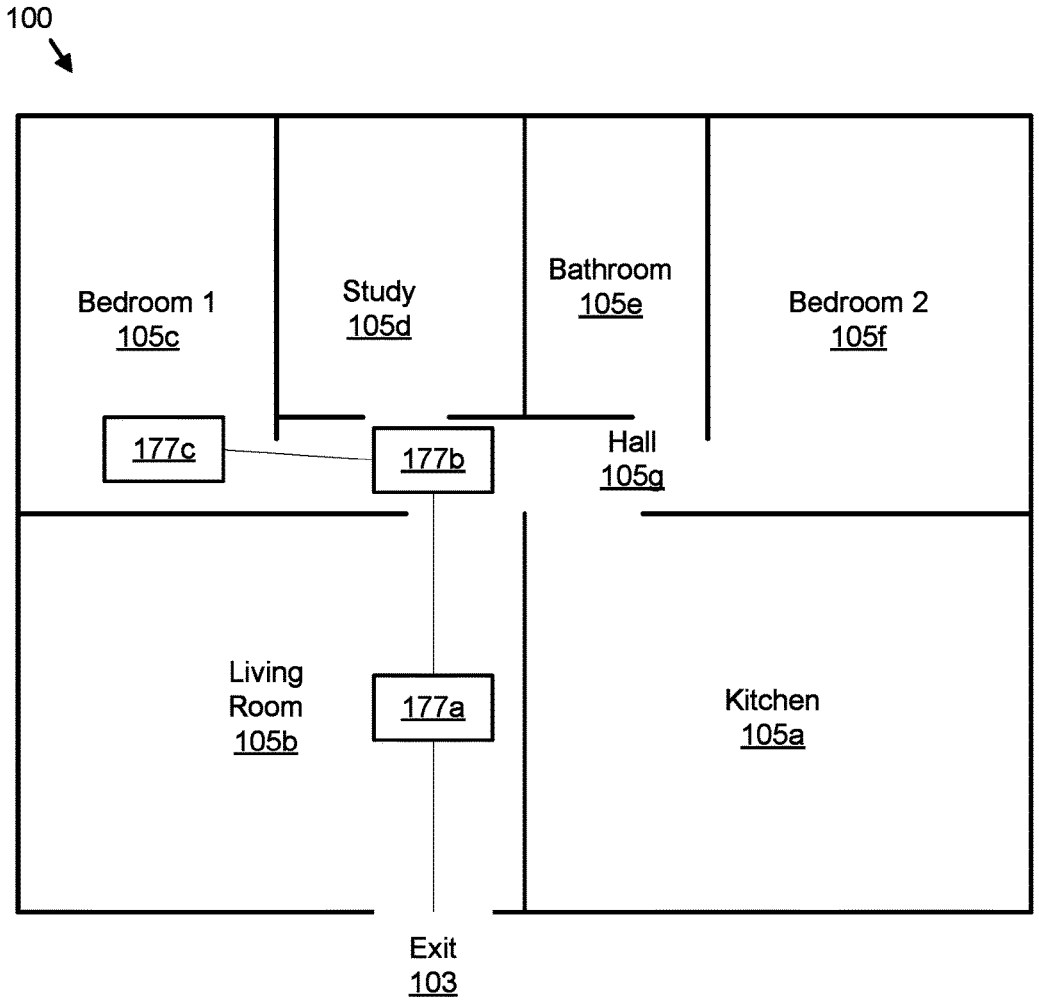
FIG. 3E is a floor plan illustrating one embodiment of a rescue route.

FIG. 3E is a floor plan illustrating one embodiment of a rescue route 177. The building alert 295 may be encoded with the rescue route 177 to guide an aid giver to an aid recipient within the building 100. In the depicted embodiment, a localized building alert 295 is communicated in each room 105 along the rescue route 177.

The rescue route 177 may be indicated by communicating the building alert 295 in each room 105 along the rescue route 177. For example, the building alert 295 may be concurrently communicated in each room 105 along the rescue route 177.

In one embodiment, the rescue route 177 is sequentially communicated in each room 105 along the rescue route 177. For example, the rescue route 177*a* may be initially indicated by communicating the localized building alert 295 in a first room 105 along the rescue route 177. When the aid giver arrives in the first room 105, the rescue route 177*b* may be further indicated by communicating the localized building alert 295 in a second room 105 along the rescue route 177. The localized building alert 295 may be subsequently communicated in each next room 105 until the aid giver reaches the aid recipient.

In one embodiment, the localized building alert 295 encodes an identity of the aid recipient. Alternatively, the localized building alert 295 may encode the needs description 255 of the aid recipient. In a certain embodiment, the localized building alert may encode the number of aid recipients.

The lights of the lighting system 125 of rooms 105 along the rescue route 177 through which the aid giver has passed may remain illuminated. In one embodiment, the building alert 295 is not communicated in rooms 105 that are not along the rescue route 177 and/or that do not have aid recipients. In a certain embodiment, the lights of the lighting system 125 are dimmed in rooms 105 that are not along the rescue route 177 and/or that do not have aid recipients.

Figure 4:
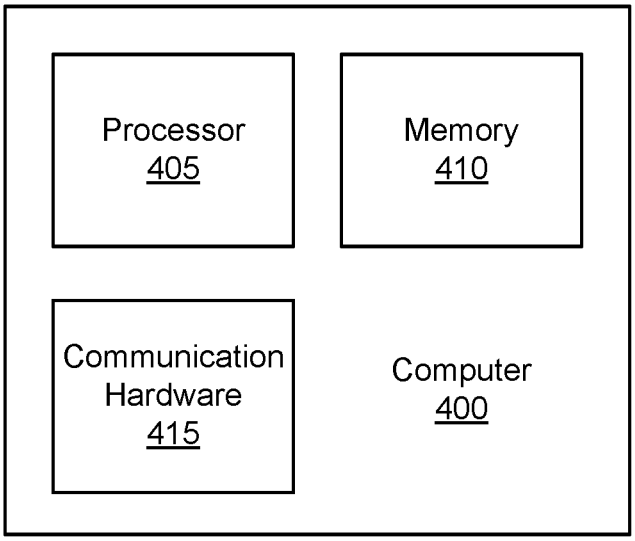
FIG. 4 is a schematic block diagram illustrating one embodiment of a computer.

FIG. 4 is a schematic block diagram illustrating one embodiment of a computer 400. The computer 400 may be embodied in the alert controller 185, the building controller 150, or combinations thereof. In the depicted embodiment, the computer 400 includes a processor 405, a memory 410, and communication hardware 415. The memory 410 may comprise a semiconductor storage device, hard disk drive, an optical storage device, a micromechanical storage device, or combinations thereof. The memory 410 may store code. The processor 405 may execute the code. The communication hardware 415 may communicate with other devices. For example, the communication hardware 415 may communicate with the network 115.

Figure 5A:
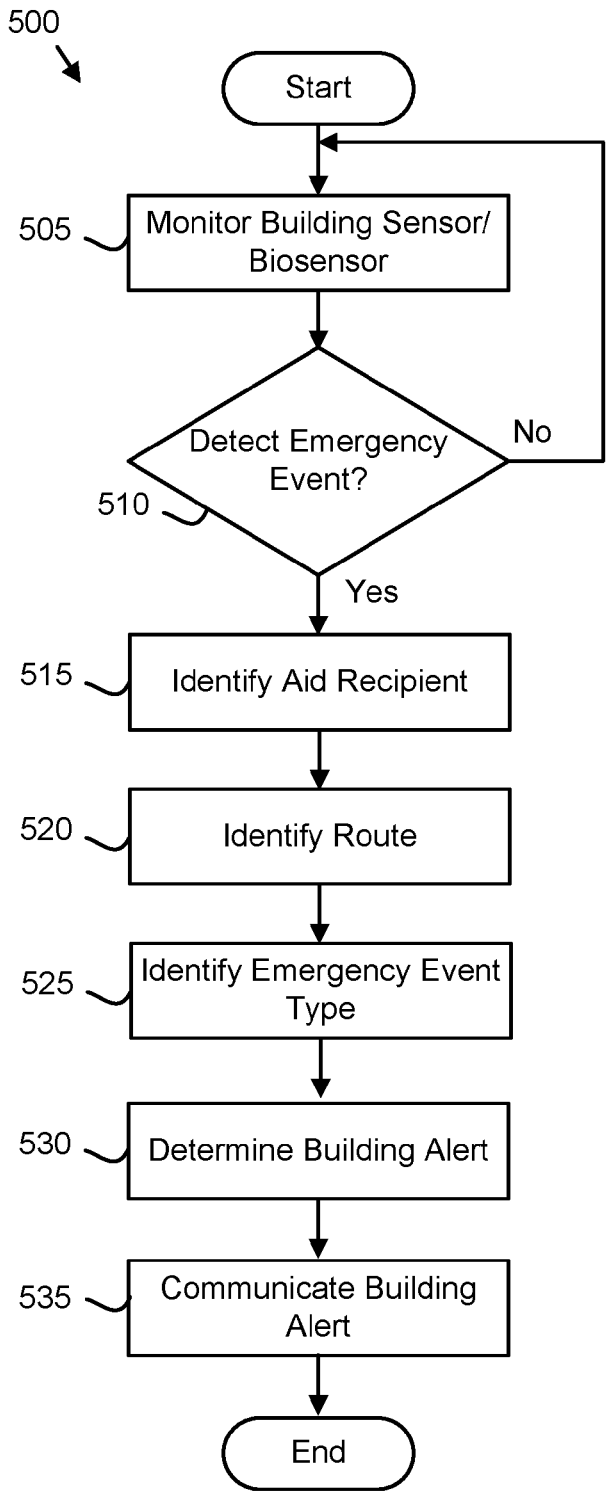
FIG. 5A is a schematic flow chart diagram illustrating one embodiment of a building alert communication method.

FIG. 5A is a schematic flow chart diagram illustrating one embodiment of a building alert communication method 500. The method 500 may detect an emergency event, determine a building alert 295 for the emergency event, and communicate the building alert 295. The method 500 may be performed by one or more processors 405 of the building alert system 120, the alert controller 185, the building controller 150, or combinations thereof.

The method 500 starts, and in one embodiment, the processor 405 monitors 505 the building sensor 145. In addition, the processor 405 may monitor 505 the biosensor 160. The processor 405 may periodically poll for sensor data 260 from the building sensor 145 and/or the biosensor 160. Alternatively, the processor 405 may listen for a communication of sensor data 260 from the building sensor 145 and/or the biosensor 160.

The processor 405 may detect 510 an emergency event. In one embodiment, the processor 405 determines if the monitored sensor data 260 matches the sensor data 260 of an entry 261 in the emergency event protocols 215. If the monitored sensor data 260 does not match the sensor data 260 of any entry 261 in the emergency event protocols 215, the processor 405 may continue to monitor 505 the building sensor 145 and/or biosensor 160.

If the monitored sensor data 260 matches the sensor data 260 of an entry 261, the processor 405 may detect 510 an emergency event. The emergency event may be of the emergency event type 265 corresponding to the sensor data 260.

The processor 405 may identify 515 one or more aid recipients in the building 100. In one embodiment, the processor 405 detects the biosensor 160 of the aid recipient to identify 515 the aid recipient. In addition, the processor 405 may identify 515 the aid recipient using the building sensor 145. For example, a camera building sensor 145 may identify 515 the aid recipient through facial recognition of the aid recipient. In addition, a processor 405 may identify 515 the aid recipient using a voice print obtained by a microphone building sensor 145 from the aid recipient. In one embodiment, the processor 405 identifies 515 the aid recipient using a wireless signal from an electronic device possessed by the aid recipient.

The processor 405 may also identify 520 a route for each aid recipient. The routes may be an egress route 175, a rescue route 177, or combinations thereof. For example, the route may guide a parent aid giver to a child aid recipient. In one embodiment, the processor 405 identifies 520 the route to avoid the emergency event. For example, if the emergency event was located in the kitchen 105*a* of FIG. 1A, the processor 405 would identify 520 the route to avoid the kitchen 105*a*.

The processor 405 may identify 525 the emergency event type 265. The emergency event type 265 may be identified from an entry 261 in the emergency event protocols 215 with sensor data 260 that corresponds to the monitored sensor data 260. Alternatively, the emergency event type 265 may be identified 525 as a function of the monitored sensor data 260.

In one embodiment, the processor 405 determines 530 the building alert 295. The building alert 295 may be localized to a portion of the building 100. In one embodiment, the building alert 295 is encoded with one or more of aid needed by the aid recipient, an identity of the aid recipient, an egress route, and a rescue route. The determination 530 of the building alert 295 is described in more detail in FIG. 5B.

In response to detecting 510 the emergency event, the processor 405 may communicate 535 the building alert 295 through the building system 195 and the method 500 ends. The building alert 295 may be communicated through the lighting system 125, the entertainment system 135, or combinations thereof. The building alert 295 may be localized by being restricted to a location of one of an aid recipient and in aid giver. For example, the localized building alert 295 may be localized to a room 105 in which an aid recipient is located. In addition, the localized building alert 295 may be localized to a room 105 in which an aid giver is located. The localized building alert 295 may further be localized to a route such as an egress route 175 or a rescue route 177.

Figure 5B:
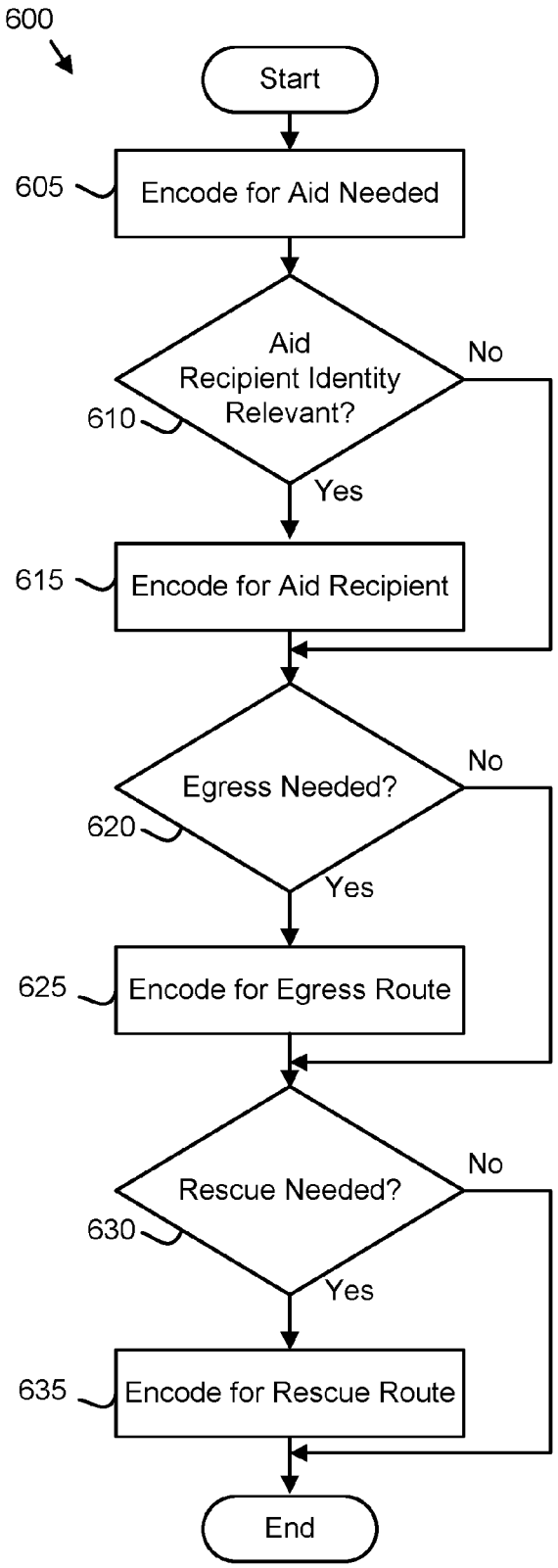
FIG. 5B is a schematic flowchart diagram illustrating one embodiment of an aid recipient/route identification method.

FIG. 5B is a schematic flowchart diagram illustrating one embodiment of an aid recipient/route identification method 600. The method 600 may perform the determine building alert step 530 of FIG. 5A. The method 500 may be performed by one or more processors 405 of the building alert system 120, the alert controller 185, the building controller 150, or combinations thereof.

The method 600 starts, and in one embodiment, the processor 405 encodes 605 the building alert 295 to indicate a type of aid that is needed by an aid recipient. In one embodiment, the processor 405 encodes 605 the building alert 295 to indicate the type of aid needed for the aid recipient as a function of the emergency event type 265, the size of the aid recipient, the mobility of the aid recipient, and the cognitive abilities of the aid recipient. Table 1 illustrates one embodiment of determining the type of aid needed for the aid recipient as a function of the emergency event type 265, the size of the aid recipient, the mobility of the aid recipient, and the cognitive abilities of the aid recipient.

TABLE 1

| Emergency Event Type | Size | Mobility | Cognitive Ability | Aid Needed |
|---|---|---|---|---|
| Medical | NA | NA | NA | Medical Aid |
| NA | Less than 40 kg | NA | NA | Evacuation Aid |
| NA | NA | Limited Mobility | NA | Evacuation Aid |
| NA | NA | NA | Limited | Evacuation Aid |
| NA | Greater than 40 kg | Mobile | Not Limited | No Aid Identified |

The building alert 295 may be encoded 605 to indicate the type of aid needed by the aid recipient. For example, if the processor 405 determines that medical aid is needed, the building alert 295 may be encoded with a pattern to indicate that medical aid is needed. In addition, if the processor 405 determines that evacuation aid is needed, the building alert 295 may be encoded with a pattern to indicate that evacuation aid is needed.

In one embodiment, the processor 405 determines 610 if the aid recipient identity is relevant to the building alert 295. The processor 405 may determine 610 that the identity of the aid recipient is not relevant if it is not known if aid recipients are in the building 100. The processor 405 may determine 610 that the aid recipient identity is relevant if one aid recipient of a plurality of aid recipients requires additional aid. For example, if one aid recipient is an infant, the processor 405 may determine 610 that the identity of the infant aid recipient is relevant. In one embodiment, the processor 405 determines 610 that the aid recipient identity is relevant if no aid recipients are known to be in the building 100.

If the processor 405 determines 610 that the aid recipient identity is not relevant to the building alert 295, the processor 405 may determine 620 if an egress is needed for the aid recipient. If the processor 405 determines 610 that the aid recipient identity is relevant to the building alert 295, the processor 405 encodes 615 the building alert 295 with the aid recipient identity. For example, the building alert 295 may be encoded with the identification code of the aid recipient. Alternatively, the building alert 295 may be encoded to indicate that no aid recipients are known to be in the building 100

The processor 405 may determine 620 if an egress from the building 100 is needed. The processor 405 may determine 620 that the egress is needed based on the emergency event type 265 and the type of aid for an aid recipient. For example, the processor 405 may determine 620 that the egress is needed in response to emergency event types 265 selected from the group consisting of fire, building collapse, and home invasion. If the processor 405 determines 620 that the egress is needed, the processor 405 may encode 625 the building alert 295 with an egress route 175. In addition, the building alert 295 may be localized to the egress route 175.

The processor 405 may determine 630 if a rescue of an aid recipient is needed. The processor 405 may determine 630 that the rescue is needed based on the type of aid for the aid recipient. For example, if the building alert 295 indicates that evacuation aid is needed for the aid recipient, the processor 405 may determine 630 that the rescue is needed.

If the processor 405 determines 630 that the rescue is not needed, the method 600 ends. If the processor 405 determines 630 that the rescue is needed, the processor 405 may encode 635 the building alert 295 with the rescue route 177 and the method 600 ends. As a result, the building alert 295 may be encoded with one or more of aid needed by an aid recipient, an identity of the aid recipient, an egress route 175, and a rescue route 177.

The processor 405 may encode the building alert as a function of the aid needed, the relevance of the aid recipient identity, the need for an egress, and the need for a rescue. Table 2 illustrates one embodiment of a function to determine the encoding for the building alert 295.

TABLE 2

| Aid Needed | Aid Recipient Relevant | Egress Needed | Rescue Needed | Building Alert |
|---|---|---|---|---|
| Medical Aid | No | No | No | Medical Aid Needed |
| Medical Aid | No | No | Yes | Rescue Route/Medical Aid Needed |
| Medical Aid | No | Yes | No | Egress Route |
| Medical Aid | No | Yes | Yes | Rescue Route/Medical Aid Needed |
| Medical Aid | Yes | No | No | Rescue Route/Aid Recipient Identify |
| Medical Aid | Yes | No | Yes | Rescue Route/Aid Recipient Identify |

TABLE 2-continued

| Aid Needed | Aid Recipient Relevant | Egress Needed | Rescue Needed | Building Alert |
|---|---|---|---|---|
| Medical Aid | Yes | Yes | No | Egress Route/Aid Recipient Identify |
| Medical Aid | Yes | Yes | Yes | Rescue Route/Aid Recipient Identify |
| Evacuation Aid | No | No | No | Rescue Route |
| Evacuation Aid | No | No | Yes | Rescue Route |
| Evacuation Aid | No | Yes | No | Rescue Route |
| Evacuation Aid | No | Yes | Yes | Rescue Route |
| Evacuation Aid | Yes | No | No | Rescue Route/Aid Recipient Identify |
| Evacuation Aid | Yes | No | Yes | Rescue Route/Aid Recipient Identify |
| Evacuation Aid | Yes | Yes | No | Rescue Route/Aid Recipient Identify |
| Evacuation Aid | Yes | Yes | Yes | Rescue Route/Aid Recipient Identify |
| No Aid Identified | No | No | No | Egress Route |
| No Aid Identified | No | No | Yes | Egress Route |
| No Aid Identified | No | Yes | No | Egress Route |
| No Aid Identified | No | Yes | Yes | Egress Route |
| No Aid Identified | Yes | No | No | Egress Route/Aid Recipient Identify |
| No Aid Identified | Yes | No | Yes | Egress Route/Aid Recipient Identify |
| No Aid Identified | Yes | Yes | No | Egress Route/Aid Recipient Identify |
| No Aid Identified | Yes | Yes | Yes | Egress Route/Aid Recipient Identify |

The embodiments detect an emergency event and in response to detecting emergency event, communicate a localized building alert 295 through a building system 195. The building alert 295 may be encoded with one or more of aid needed by an aid recipient, an identity of the aid recipient, an egress route, and a rescue route. The building alert 295 may be localized by being restricted to a location of one of the aid recipient and/or an aid giver. In addition, the building alert 295 may be localized to a route. As a result, targeted, timely information is provided to the aid recipient and/or aid giver based on the emergency event and/or other relevant factors.

Embodiments may be practiced in other specific forms. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus comprising:

a building controller that controls a building system that comprises a lighting system;

a processor;

a memory that stores code executable by the processor to:

detect an emergency event;

in response to detecting the emergency event, identify an aid recipient with a needs description specifying that the aid recipient is unable to walk;

identify an egress route comprising a sequential order of rooms; and communicate a localized building alert through the lighting system, wherein the localized building alert encodes that the aid recipient is unable to walk with a specified number of off pulses of lights of the lighting system that occur periodically and is communicated sequentially along the egress route from the lighting system of each next room along the egress route, wherein the localized building alert is no longer communicated in each room after detecting that the aid recipient leaves the room.

2. The apparatus of claim 1, wherein the localized building alert is further encoded with one or more of aid needed by the aid recipient, an identity of the aid recipient, and a rescue route.

3. The apparatus of claim 1, wherein the code is further executable by the processor to:

monitor building sensors;

identify an emergency event type from sensor data from the building sensors; and determine the localized building alert in response to the emergency event type.

4. The apparatus of claim 1, wherein the emergency event is a physical emergency event detected by a building sensor and the physical emergency event is selected from the group consisting of a fire, a flood, extreme weather, and a home invasion.

5. The apparatus of claim 1, wherein the emergency event is a medical emergency event type detected by a biosensor.

6. A method comprising:

detecting, by use of a processor, an emergency event;

in response to detecting the emergency event, identifying an aid recipient with a needs description specifying that the aid recipient is unable to walk;

identifying an egress route comprising a sequential order of rooms; and communicating a localized building alert through a building system, wherein the localized building alert encodes that the aid recipient is unable to walk with a specified number of off pulses of lights of the lighting system that occur periodically and is communicated sequentially along the egress route from the lighting system of each next room along the egress route, wherein the localized building alert is no longer communicated in each room after detecting that the aid recipient leaves the room.

7. The method of claim 6, wherein the localized building alert is further encoded with one or more of aid needed by the aid recipient, an identity of the aid recipient and a rescue route.

8. The method of claim 6, wherein the method further comprises:

monitoring building sensors;

identifying an emergency event type from sensor data from the building sensors; and determining the localized building alert in response to the emergency event type.

9. The method of claim 6, wherein the emergency event is a physical emergency event detected by a building sensor and the physical emergency event is selected from the group consisting of a fire, a flood, extreme weather, and a home invasion.

10. The method of claim 6, wherein the emergency event is a medical emergency event type detected by a biosensor.

11. A program product comprising a non-transitory computer readable storage medium that stores code executable by a processor, the executable code comprising code to perform: detecting an emergency event; in response to detecting the emergency event, identifying an aid recipient with a needs description specifying that the aid recipient is unable to walk; identifying an egress route comprising a sequential order of rooms; and communicating a localized building alert through a building system, wherein the localized building alert encodes that the aid recipient is unable to walk with a specified number of off pulses of lights of the lighting system that occur periodically and is communicated sequentially along the egress route from the lighting system of each next room along the egress route, wherein the localized building alert is no longer communicated in each room after detecting that the aid recipient leaves the room.

12. The program product of claim 11, wherein the localized building alert is further encoded with one or more of aid needed by the aid recipient, an identity of the aid recipient and a rescue route.

13. The program product of claim 11, wherein the processor further performs:

monitoring building sensors;

identifying an emergency event type from sensor data from the building sensors; and determining the localized building alert in response to the emergency event type.

* * * * *